US010933649B2

(12) United States Patent
Ueda et al.

(10) Patent No.: US 10,933,649 B2
(45) Date of Patent: Mar. 2, 2021

(54) LIQUID DISCHARGE DEVICE

(71) Applicant: BROTHER KOGYO KABUSHIKI KAISHA, Nagoya (JP)

(72) Inventors: Toshiro Ueda, Inazawa (JP); Mikio Ogawa, Nagoya (JP); Kenta Horade, Toukai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/022,596

(22) Filed: Sep. 16, 2020

(65) Prior Publication Data

US 2020/0406628 A1 Dec. 31, 2020

Related U.S. Application Data

(63) Continuation of application No. 16/156,159, filed on Oct. 10, 2018, now Pat. No. 10,800,178.

(30) Foreign Application Priority Data

Oct. 10, 2017 (JP) ..... JP2017-197176

(51) Int. Cl.

| | |
|---|---|
| ***B41J 2/175*** | (2006.01) |
| ***B41J 29/38*** | (2006.01) |
| ***B41J 29/13*** | (2006.01) |

(52) U.S. Cl.

CPC ..... *B41J 2/17566* (2013.01); *B41J 2/1752* (2013.01); *B41J 2/17509* (2013.01); *B41J 2/17513* (2013.01); *B41J 2/17523* (2013.01); *B41J 2/17553* (2013.01); *B41J 29/13* (2013.01); *B41J 29/38* (2013.01); *B41J 2002/17573* (2013.01); *B41J 2002/17576* (2013.01)

(58) Field of Classification Search

CPC .... B41J 2/175; B41J 2/17503; B41J 2/17506; B41J 2/17509; B41J 2/17513; B41J 2/1752; B41J 2/17543; B41J 2/17546; B41J 2/1755; B41J 2/17566

See application file for complete search history.

(56) References Cited

U.S. PATENT DOCUMENTS

| | | | |
|---|---|---|---|
| 2005/0068386 | A1 | 3/2005 | Hatasa et al. |
| 2008/0198207 | A1 | 8/2008 | Katada |
| 2008/0204488 | A1 | 8/2008 | Usui |
| 2008/0231676 | A1 | 9/2008 | Shimizu |
| 2010/0231641 | A1 | 9/2010 | Danzuka |
| 2016/0016407 | A1 | 1/2016 | Nagase et al. |
| 2016/0052276 | A1 | 2/2016 | Tenkawa et al. |

(Continued)

FOREIGN PATENT DOCUMENTS

| | | | |
|---|---|---|---|
| JP | 2005-103855 | A | 4/2005 |
| JP | 2008-213162 | A | 9/2008 |

(Continued)

OTHER PUBLICATIONS

Notice of Allowance issued in related U.S. Appl. No. 16/227,151, dated Apr. 30, 2020.

*Primary Examiner* — Scott A Richmond
(74) *Attorney, Agent, or Firm* — Merchant & Gould P.C.

(57) ABSTRACT

The liquid discharge device starts executing an initial process of discharging the liquid, based on determining that a low level signal is received after receiving a high level signal from an installation sensor and that a low level signal is received after receiving a high level signal from a liquid level sensor.

8 Claims, 13 Drawing Sheets

(56) References Cited

U.S. PATENT DOCUMENTS

| | | | |
|---|---|---|---|
| 2016/0279962 | A1 | 9/2016 | Ishida et al. |
| 2016/0279963 | A1 | 9/2016 | Koganehira et al. |
| 2017/0190186 | A1 | 7/2017 | Kubota et al. |

FOREIGN PATENT DOCUMENTS

| | | | |
|---|---|---|---|
| JP | 2010-058305 | A | 3/2010 |
| JP | 2014-233858 | A | 12/2014 |
| JP | 2016-190361 | A | 11/2016 |

LIQUID DISCHARGE DEVICE

CROSS-REFERENCE TO RELATED APPLICATION

This application is a continuation of U.S. application Ser. No. 16/156,159, filed Oct. 10, 2018, which claims priorities from Japanese Patent Application No. 2017-197176 filed on Oct. 10, 2017, the entire subject matters of which are incorporated herein by reference.

TECHNICAL FIELD

The present disclosure relates to a liquid discharge device for discharging a liquid.

BACKGROUND

From the related art, an inkjet printer is known (for example, JP-A-2008-213162) which includes a detachable main tank, a sub tank that stores ink supplied from the mounted main tank, and an image recording unit that discharges the ink stored in the sub tank and records an image. In the inkjet printer having the above configuration, internal spaces of the main tank and the sub tank are opened to the air. For this reason, when the main tank is installed in the inkjet printer, the ink moves due to a water head pressure so that the liquid level of the main tank and the liquid level of the sub tank are aligned with the same height by the difference between a water head in the internal space of the main tank and a water head in the internal space of the sub tank (hereinafter, referred to as "water head difference").

An initial process of ink is set as an initial operation of the inkjet printer. The initial process is an operation for causing ink to flow from the sub tank to the recording head after the main tank is installed into the inkjet printer so that the recording head can discharge the ink. In the initial process, it is desirable that the ink is stored in the sub tank so that air does not enter the flow path of the ink extending from the sub tank to the recording head. Therefore, it is considered that the initial process is started after the main tank is installed into the inkjet printer and the liquid level of the main tank has the same height as the liquid level of the sub tank by the inflow of the ink from the main tank to the sub tank due to the water head pressure.

However, if the time until the initial process is executed from when the main tank is installed into the inkjet printer becomes long, the user may wait for a long period of time before the inkjet printer becomes usable.

SUMMARY

The present disclosure has been made in view of the above circumstances, and one of objects of the present disclosure is to provide a unit capable of shortening the time until the initial process of flowing the liquid from the second liquid chamber to the head is executed from when the cartridge is installed in the installation case.

According to an illustrative embodiment of the present disclosure, there is provided a liquid discharge device including: an installation case configured to receive a cartridge, the cartridge including: a first liquid chamber in which a liquid is stored; a first flow path. one end of the first flow path being communicated with the first liquid chamber, the other end of the first flow path being communicated with the outside of the cartridge; and a second flow path, one end of the second flow path being communicated with the first liquid chamber, the other end of the second flow path being communicated with the outside of the cartridge; a tank including: a second liquid chamber; a third flow path, one end of the third flow path being communicated with the outside of the cartridge, the other end of the third flow path being communicated with the second liquid chamber, at least one of the first flow path and the third flow path being configured to communicate with the first liquid chamber of the cartridge installed in the installation case and the second liquid chamber; a fourth flow path, one end of the fourth flow path being located below the third flow path communicates with the second liquid chamber; and a fifth flow path, one end of the fifth flow path being communicated with the second liquid chamber, the other end of the fifth flow path being communicated with the outside of the cartridge; a head that is communicated with the other end of the fourth flow path; a liquid level sensor; and a controller. The controller is configured to: receive a first signal from the liquid level sensor in a case where a position of a liquid level in the second liquid chamber is equal to or higher than a predetermined position; receive a second signal from the liquid level sensor in a case where the position of the liquid level in the second liquid chamber is lower than the predetermined position; determine that the cartridge is installed in the installation case; and based on determining that the first signal is received from the liquid level sensor after receiving the second signal based on determining that the cartridge is installed in the installation case, execute an initial process of introducing the liquid stored in the first liquid chamber to the head and the fourth flow path.

According to another illustrative embodiment of the present disclosure, there is provided a liquid discharge device including: an installation case configured to receive a cartridge, the cartridge including: a first liquid chamber in which a liquid is stored; a first flow path, one end of the first flow path being communicated with the first liquid chamber, the other end of the first flow path being communicated with the outside of the cartridge; and a second flow path, one end of the second flow path being communicated with the first liquid chamber, the other end of the second flow path being communicated with the outside of the cartridge; a tank including: a second liquid chamber; a third flow path, one end of the third flow path being communicated with the outside of the cartridge, the other end of the third flow path being communicated with the second liquid chamber, at least one of the first flow path and the third flow path being configured to communicate with the first liquid chamber of the cartridge installed in the installation case and the second liquid chamber; a fourth flow path, one end of the fourth flow path being located below the third flow path communicates with the second liquid chamber; and a fifth flow path, one end of the fifth flow path being communicated with the second liquid chamber, the other end of the fifth flow path being communicated with the outside of the cartridge; a head that is communicated with the other end of the fourth flow path; and a controller. The controller is configured to: determine that the cartridge is installed in the installation case; and in a case where an elapsed time from a time point at which being determined that the cartridge is installed in the installation sensor reaches a fourth time, execute an initial process of introducing the liquid stored in the first liquid chamber to the head and the fourth flow path.

According to another illustrative embodiment of the present disclosure, there is provided a liquid discharge device including: an installation case configured to receive a cartridge, the cartridge including: a first liquid chamber in which a liquid is stored; a first flow path, one end of the first flow path being communicated with the first liquid chamber, the other end of the first flow path being communicated with the outside of the cartridge; and a second flow path, one end of the second flow path being communicated with the first liquid chamber, the other end of the second flow path being communicated with the outside of the cartridge; a tank including: a second liquid chamber; a third flow path, one end of the third flow path being communicated with the outside of the cartridge, the other end of the third flow path being communicated with the second liquid chamber, at least one of the first flow path and the third flow path being configured to communicate with the first liquid chamber of the cartridge installed in the installation case and the second liquid chamber; a fourth flow path, one end of the fourth flow path being located below the third flow path communicates with the second liquid chamber; and a fifth flow path, one end of the fifth flow path being communicated with the second liquid chamber, the other end of the fifth flow path being communicated with the outside of the cartridge; a head that communicates with the other end of the fourth flow path; an interface; and a controller. The controller is configured to: determine that the cartridge is installed in the installation case; after determining that the cartridge is installed in the installation case, read a liquid amount Vc of a liquid stored in the first liquid chamber from a memory of the cartridge through the interface; based on the read liquid amount Vc, determine a flow rate Qc at which the liquid flows from the first liquid chamber to the second liquid chamber; calculate a liquid amount Vs of a liquid stored in the second liquid chamber by multiplying the flow rate Qc by an elapsed time from a time point at which being determined that the cartridge is installed in the installation case; and based on the flow rate Qc is equal to or larger than a first threshold and the liquid amount Vs is equal to larger than a second threshold, execute an initial process of introducing the liquid stored in the first liquid chamber to the head and the fourth flow path.

DETAILED DESCRIPTION

Figure 1A:
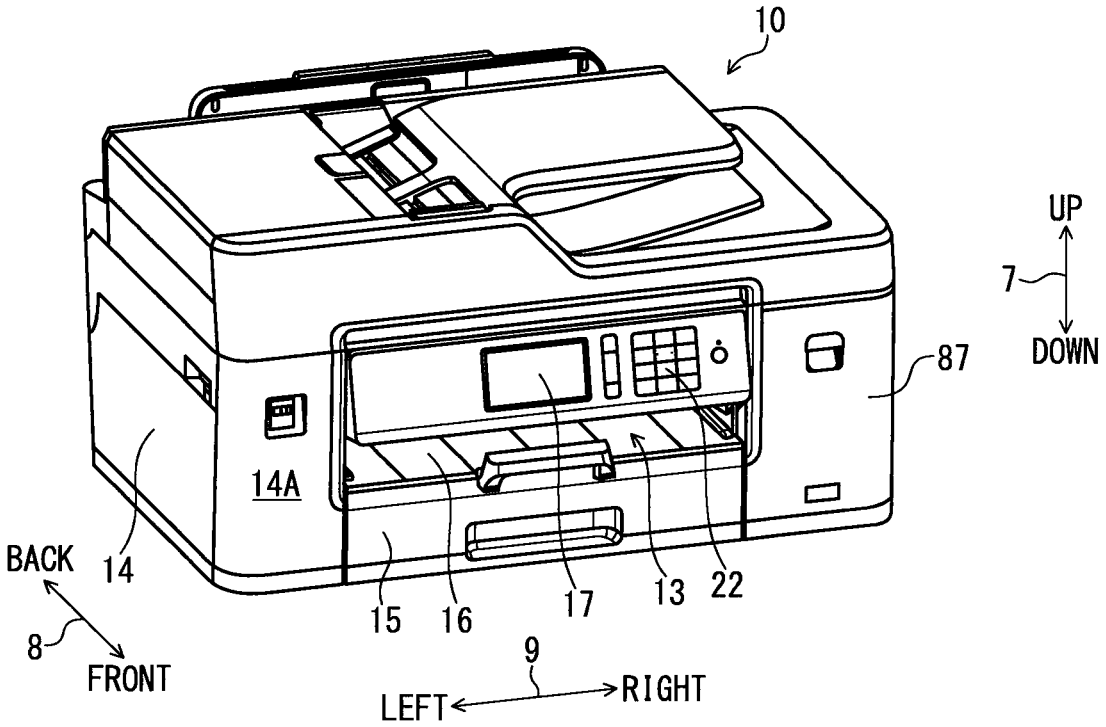
FIG. 1A is an external perspective view of a printer and illustrates a state where a cover is in a covering position.

An embodiment of the invention will be described below. It is noted that the embodiment described below is merely an example and can be appropriately modified. In addition, an up and down direction 7 is defined with reference to a posture of a printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. In the embodiment, the up and down direction 7 in the use posture corresponds to a vertical direction, and the front and back direction 8 and the left and right direction 9 correspond to a horizontal direction. The front and back direction 8 and the left and right direction 9 are orthogonal to each other.

In this disclosure, some items and members are described by usage of ordinal numbers. However, the ordinal numbers are used for identifying each of the items and members, and that the usage or the ordinal numbers does not limit or specify the numbers of each of the items and members provided in the liquid discharge device.

First Embodiment

[Outline of Printer 10]

The printer 10 according to the embodiment is an example of a liquid discharge device that records an image on a sheet using an inkjet recording method. The printer 10 has a housing 14 having substantially rectangular parallelepiped shape. Further, the printer 10 may be a so-called "multi-function peripheral" having a facsimile function, a scan function, and a copy function.

Figure 1B:
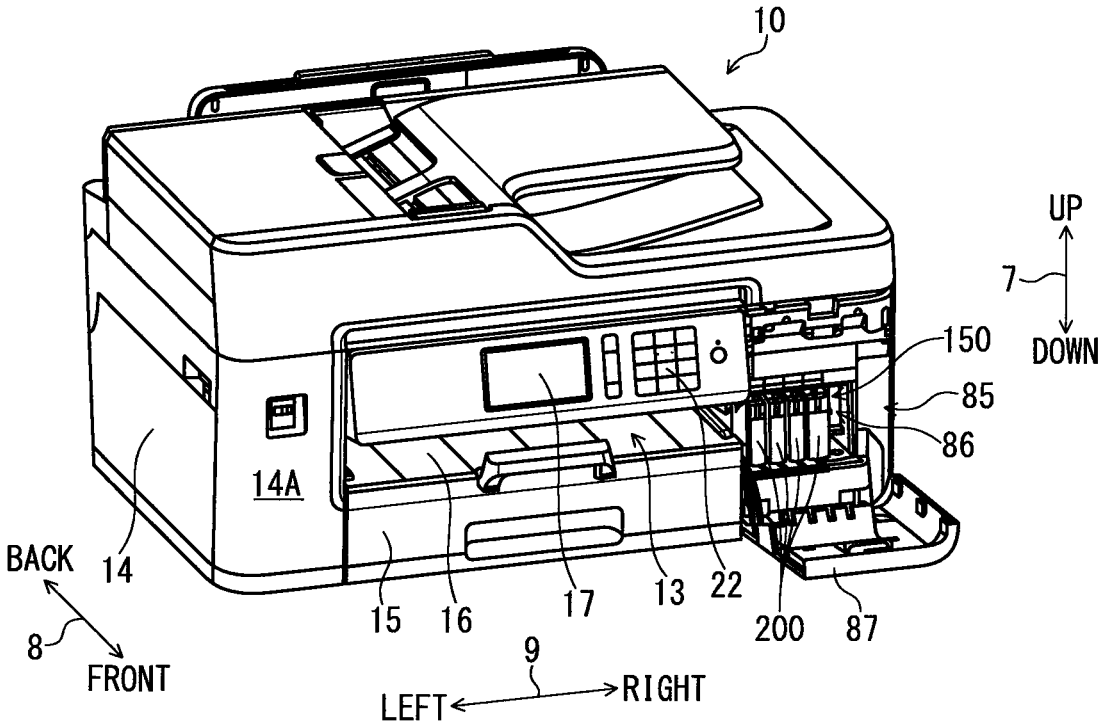
FIG. 1B is an external perspective view of the printer and illustrates a state where the cover is in an exposing position.
Figure 2:
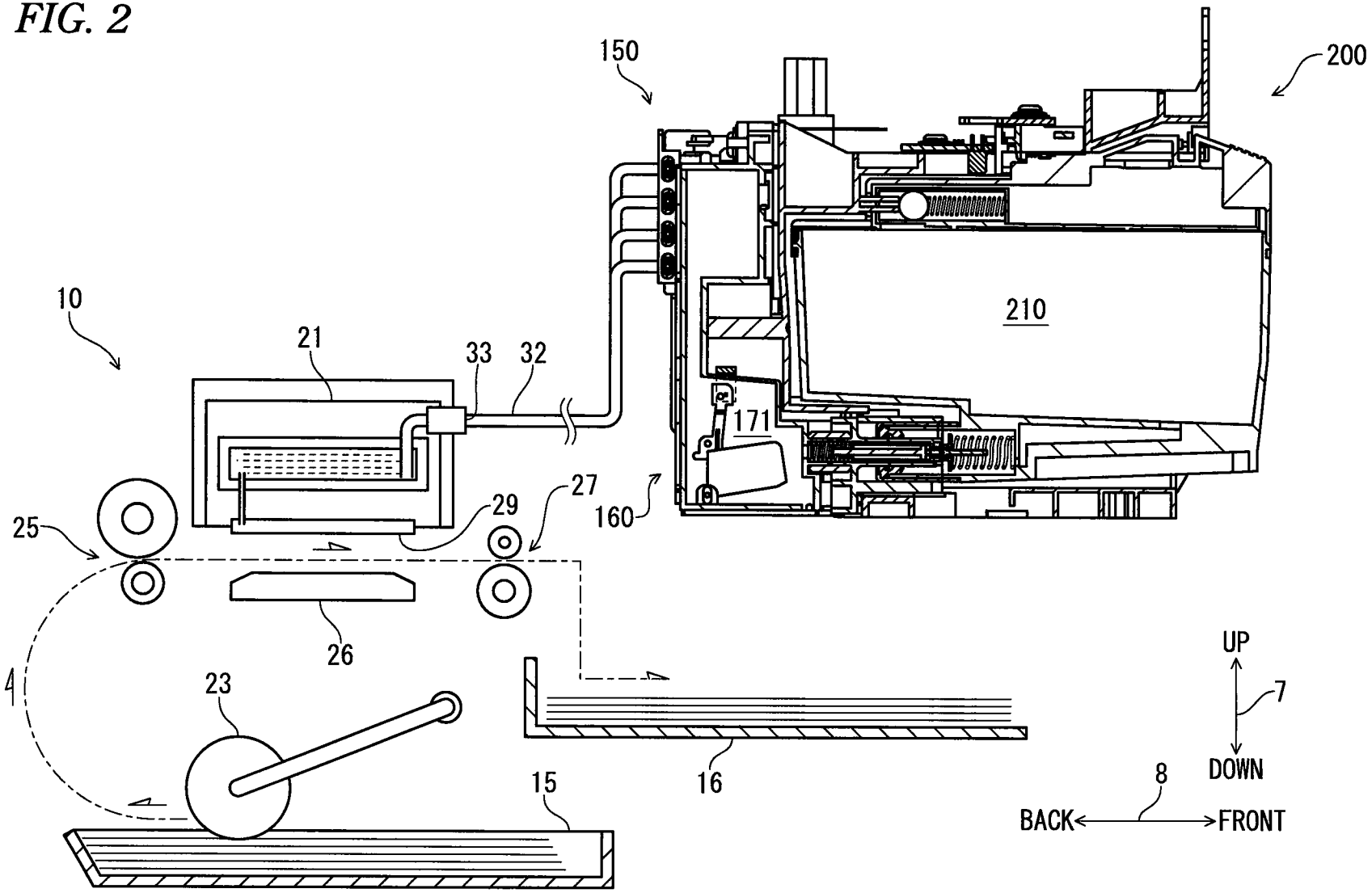
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

More specifically, the head 21 may be installed in a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

In the embodiment, the discharge of ink from the nozzle 29 of the head 21 in the image recording is referred to as "jetting", while the discharge of ink from the nozzle 29 of the head 21 in the purging is referred to as "jetting", but the "jetting" is conceptually included in the "discharge".

[Cover 87]

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads backwards from the opening 85.

[Cover Sensor 88]

Figure 6:
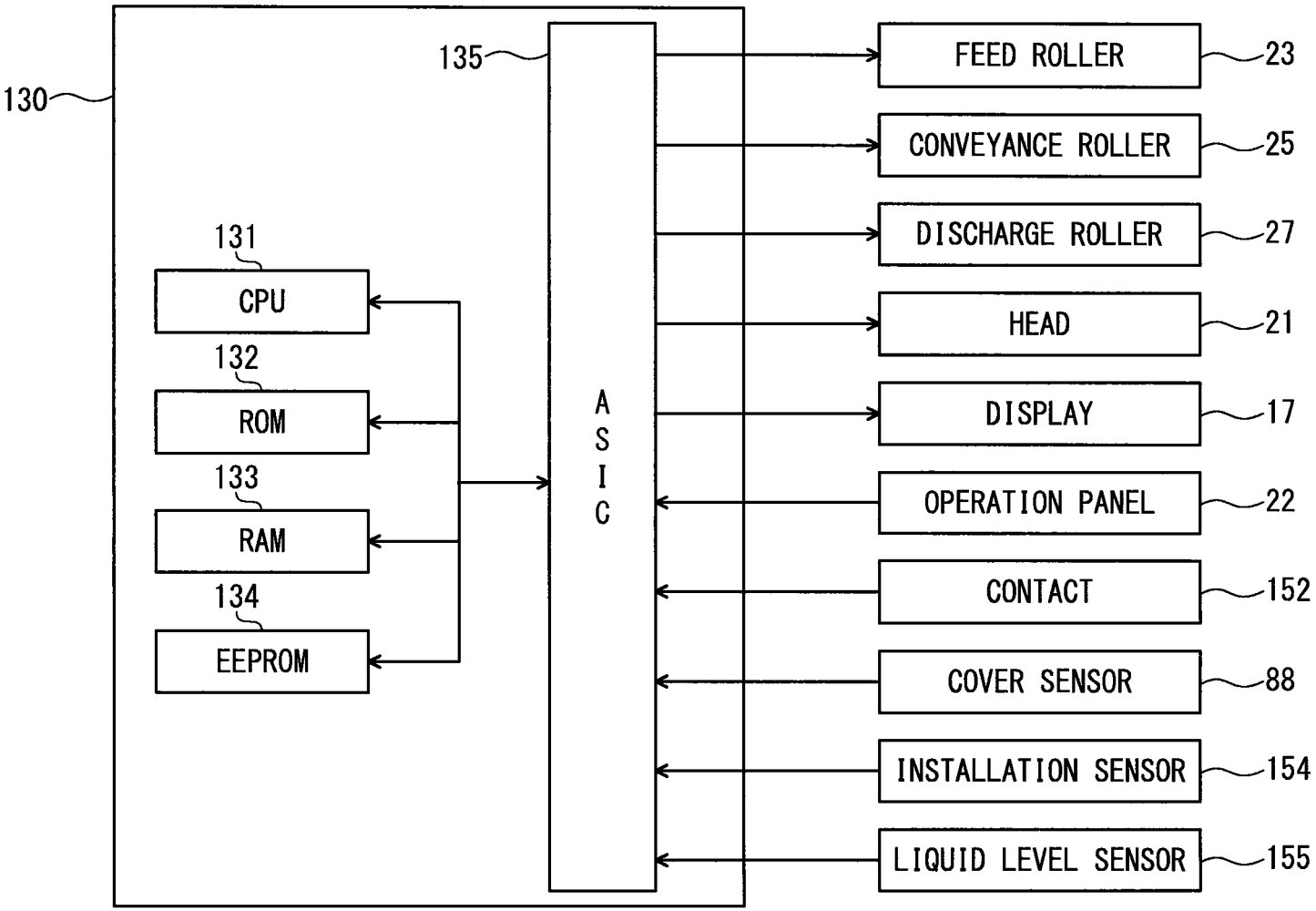
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal intensity than the low-level signal to the controller 130 when the cover 87 is located at a position different from the covering position. In other words, the cover sensor 88 outputs the high-level signal to the controller 130 when the cover 87 is located at the exposing position.

[Installation Case 150]

Figure 3:
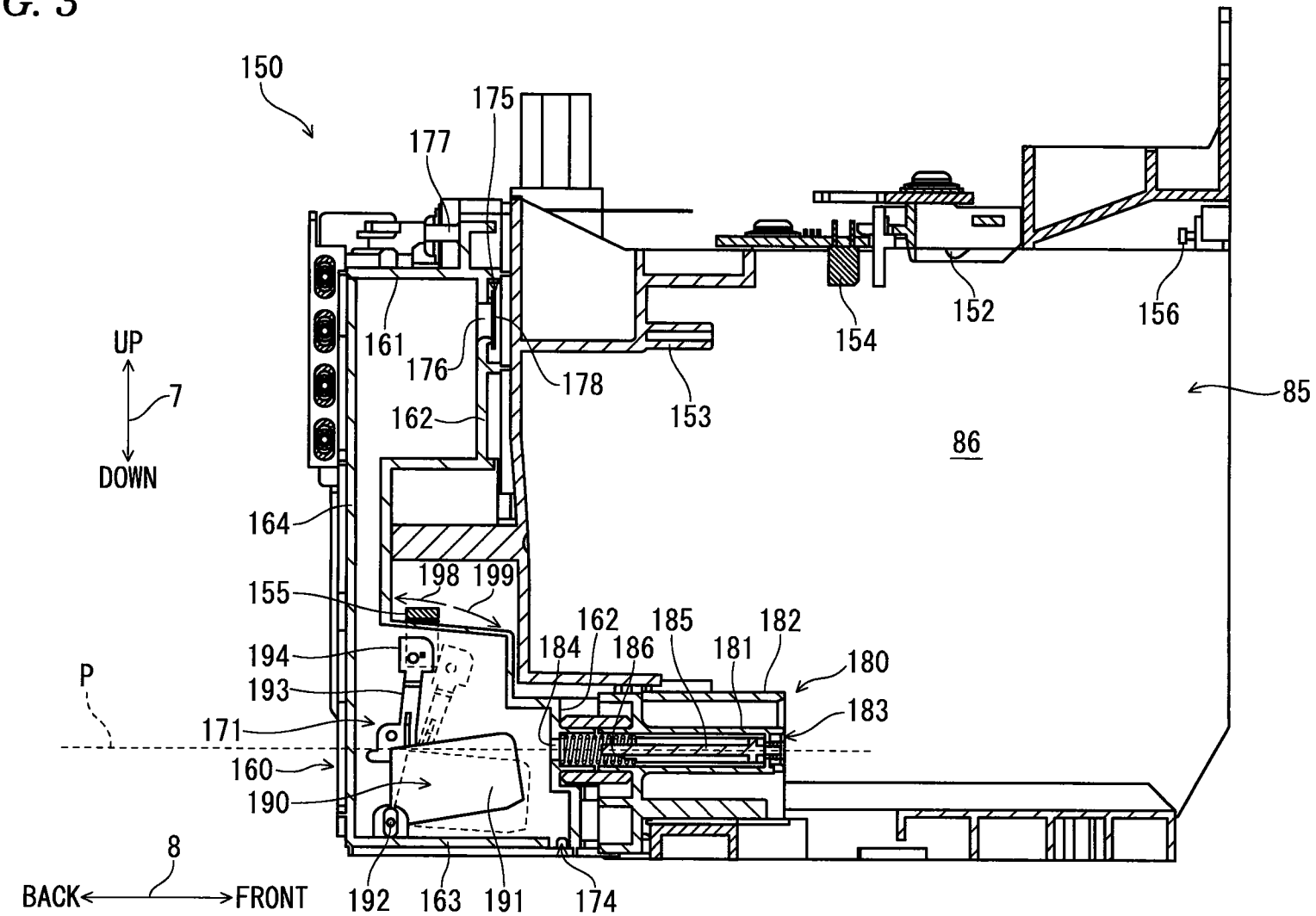
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be mounted. The contact 152 is an example of an interface.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

[Contact 152]

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130. The contact 152 is an example of an interface.

[Rod 153]

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

[Installation Sensor 154]

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal to the controller when an intensity of the light received by the light receiving portion is lower than threshold intensity, for example. Meanwhile, the installation sensor 154 outputs a high-level signal having higher signal intensity than the low-level signal to the controller 130 when the intensity of the light received by the light receiving portion is equal to or higher than the threshold intensity. The high-level signal is an example of a third signal, and the low-level signal is an example of a fourth signal.

[Liquid Level Sensor 155]

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion. The installation sensor 155 outputs a low-level signal to the controller when an intensity of the light received by the light receiving portion is lower than threshold intensity, for example. Meanwhile, the installation sensor 155 outputs a high-level signal having higher signal intensity than the low-level signal to the controller 130 when the intensity of the light received by the light receiving portion is equal to or higher than the threshold intensity. The low-level signal is an example of a first signal. The high-level signal is an example of a second signal.

[Lock Pin 156]

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at a installation position illustrated in FIG. 5. The cartridge 200 is engaged with the lock pin 156 in a state of being installed in the installation case 150.

[Tank 160]

The printer 10 includes four tanks 160 corresponding to four cartridges 200. The tank 160 is located backwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through-hole 184) in the up and down direction 7. The ink flow path (not illustrated) communicating with the outflow port 174 communicates with the tube 32 (see FIG. 2). Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a fourth flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through-hole 176 penetrating the front wall 162. The through-hole 176 is closed by a semipermeable membrane 178. The semipermeable membrane 178 allows the air to pass therethrough, but does not allow the ink to pass therethrough, or applies larger resistance to the passage of the ink compared to the passage of the air. In addition, the air communication chamber 175 communicates with the outside of the printer 10 through an air communication port 177 and a tube (not illustrated) connected to the air communication port 177. That is, the air communication chamber 175 is an example of a fifth flow path in which one end (through-hole 176) communicates with the liquid chamber 171 and the other end (air communication port 177) communicates with the outside of the printer 10. The air communication chamber 175 communicates with the air through the air communication port 177 and the tube (not illustrated).

[Joint 180]

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through-hole 184 penetrating the front wall 162. The needle 181 is an example of a third flow path in which one end (opening 183) communicates with the outside of the tank 160 and the other end (through-hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an opened position in the front and back direction 8. The valve 185 closes the opening 183 when being positioned at the closed position. Further, the valve 185 opens the opening 183 when being located at the opened position. The coil spring 186 urges forward the valve 185 in a moving direction from the opened position to the closed position, that is, the front and back direction 8.

[Actuator 190]

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and back direction 8. The detection target portion 194 is formed of a material or color that shields the light output from the light emitting portion of the liquid level sensor 155.

When a liquid level of the ink stored in the liquid chamber 171 is equal to or higher than a predetermined position P, the actuator 190 rotated in the direction of the arrow 198 by buoyancy is held at the detection position indicated by the solid line in FIG. 3, by the stopper. On the other hand, when the liquid level of the ink is lower than the predetermined position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The predetermined position P has the same height as an axial center of the needle 181 in the up and down direction 7, and has the same height as a center of an ink supply port 234 (to be described below). However, the predetermined position P is not limited to the position as long as it is located above the outflow port 174 in the up and down direction 7. As another example, the predetermined position P may be a height of the upper end or the lower end of the internal space of the needle 181, or may be a height of an upper end or a lower end of the ink supply port 234.

When the liquid level of the ink stored in the liquid chamber 171 is equal to or higher than the predetermined position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the predetermined position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the predetermined position P.

[Cartridge 200]

Figure 4A:
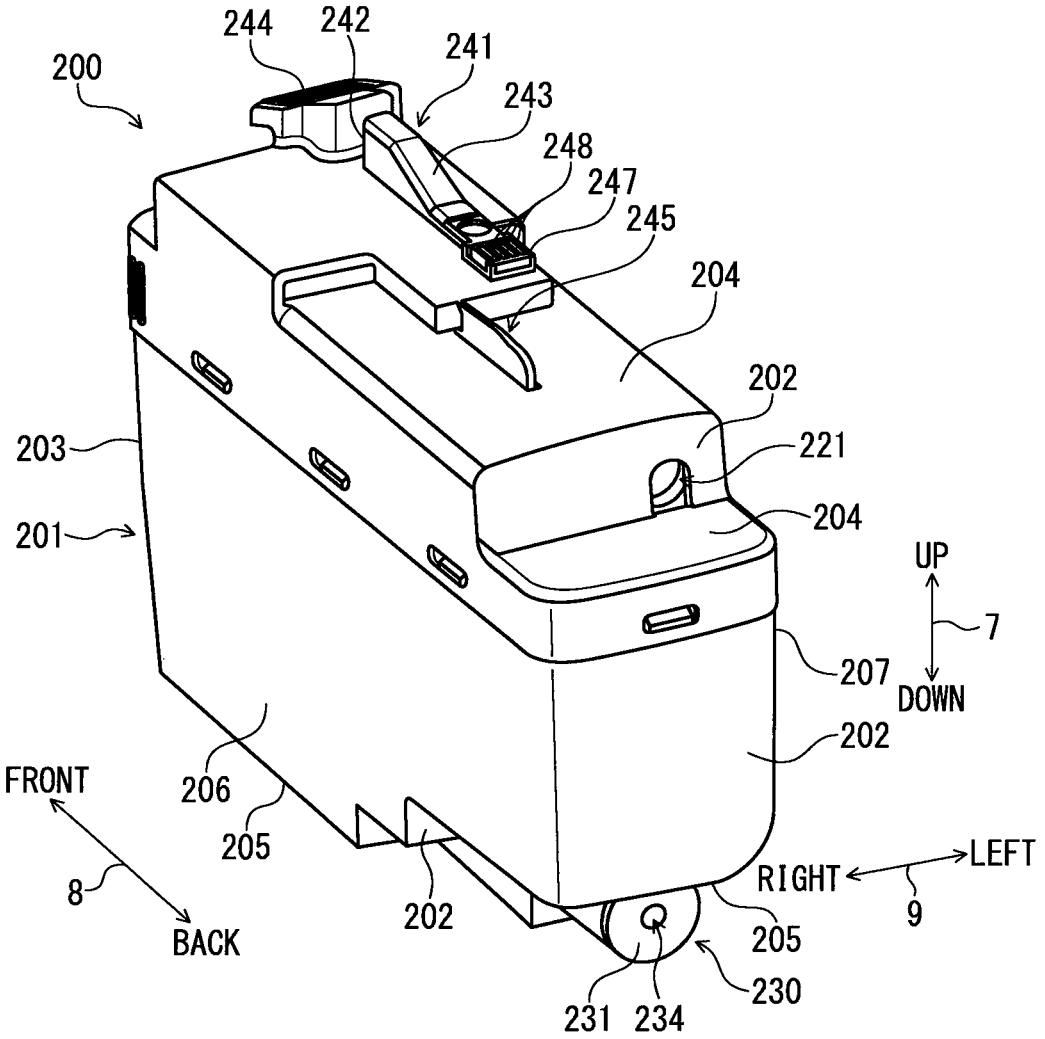
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 4B:
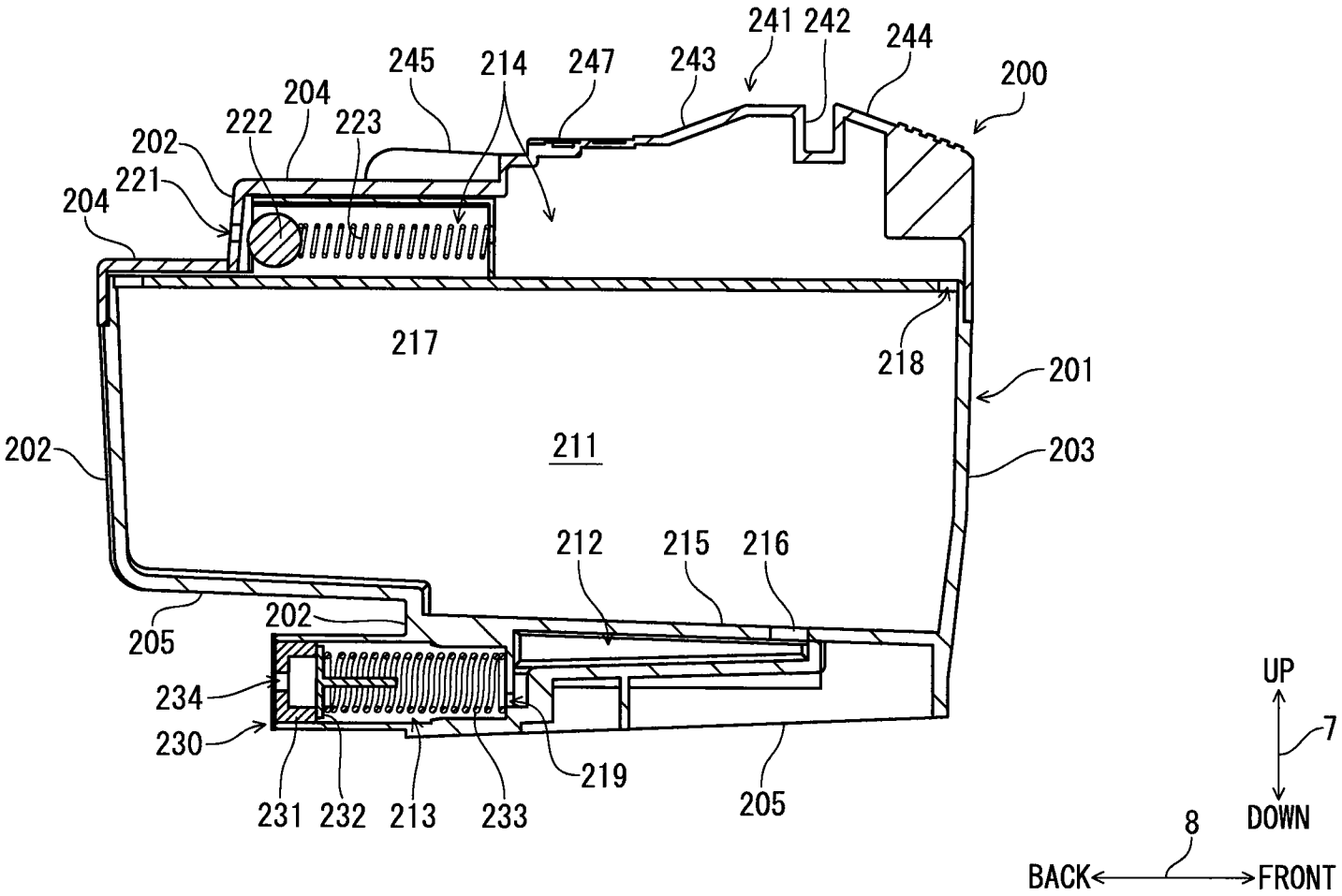
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through-hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through-hole 218 formed in the partition wall 217. Further, the ink valve chamber 213 communicates with a lower end of the lower liquid chamber 212 through a through-hole 219.

The air valve chamber 214 communicates with the outside of the cartridge 200 through the air communication port 221 formed in the rear wall 202 at the upper part of the cartridge 200. That is, the air valve chamber 214 is an example of a second flow path in which one end (through-hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an opened position in the front and back direction 8. When being located at the closed position, the valve 222 closes the air communication port 221. Further, when being located at the opened position, the valve 222 opens the air communication port 221. The coil spring 223 urges backward the valve 222 in a moving direction from the opened position to the closed position, that is, the front and back direction 8.

The air valve chamber 214 is divided into two rooms in the front and back direction 8 by a partition wall 224. The room located on the rear side in the front and back direction 8 is provided with the valve 222 and the coil spring 223, and communicates with the outside through the air communication port 221. The room located on the front side in the front and back direction 8 communicates with the upper liquid chamber 211 through the through-hole 218. The partition wall 224 is formed with the through-hole 225. The through-hole 225 communicates with the two rooms divided in the front and back direction 8. The through-hole 225 is closed by the semipermeable membrane 226. The semipermeable membrane 226 allows the air to pass therethrough, but does not allow the ink to pass therethrough, or applies larger resistance to the passage of the ink compared to the passage of the air.

The rod 153 enters the air valve chamber 214 through the air communication port 221 in the course of installing the cartridge 200 on the installation case 150. The rod 153 having entered the air valve chamber 214 moves forward the valve 222 located at the closed position against an urging force of the coil spring 223. Then, as the valve 222 moves to the opened position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through-hole 219 and the outside of the cartridge 200 to communicate with each other. The ink valve chamber 213 is an example of a first flow path in which one end (through-hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and back direction 8 is formed. An inner diameter of the ink supply port 234 is slightly smaller than an outer diameter of the needle 181. The valve 232 is movable between a closed position and an opened position in the front and back direction 8. When being located at the closed position, the valve 232 comes in contact with the packing 231 and closes the ink supply port 234. Further, when being located at the opened position, the valve 232 separates from the packing 231 and opens the ink supply port 234. The coil spring 233 urges backward the valve 232 in a moving direction from the opened position to the closed position, that is, the front and back direction 8. In addition, the urging force of the coil spring 233 is larger than that of the coil spring 186.

The supply tube 230 enters the guide 182 in the course of installing the cartridge 200 on the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
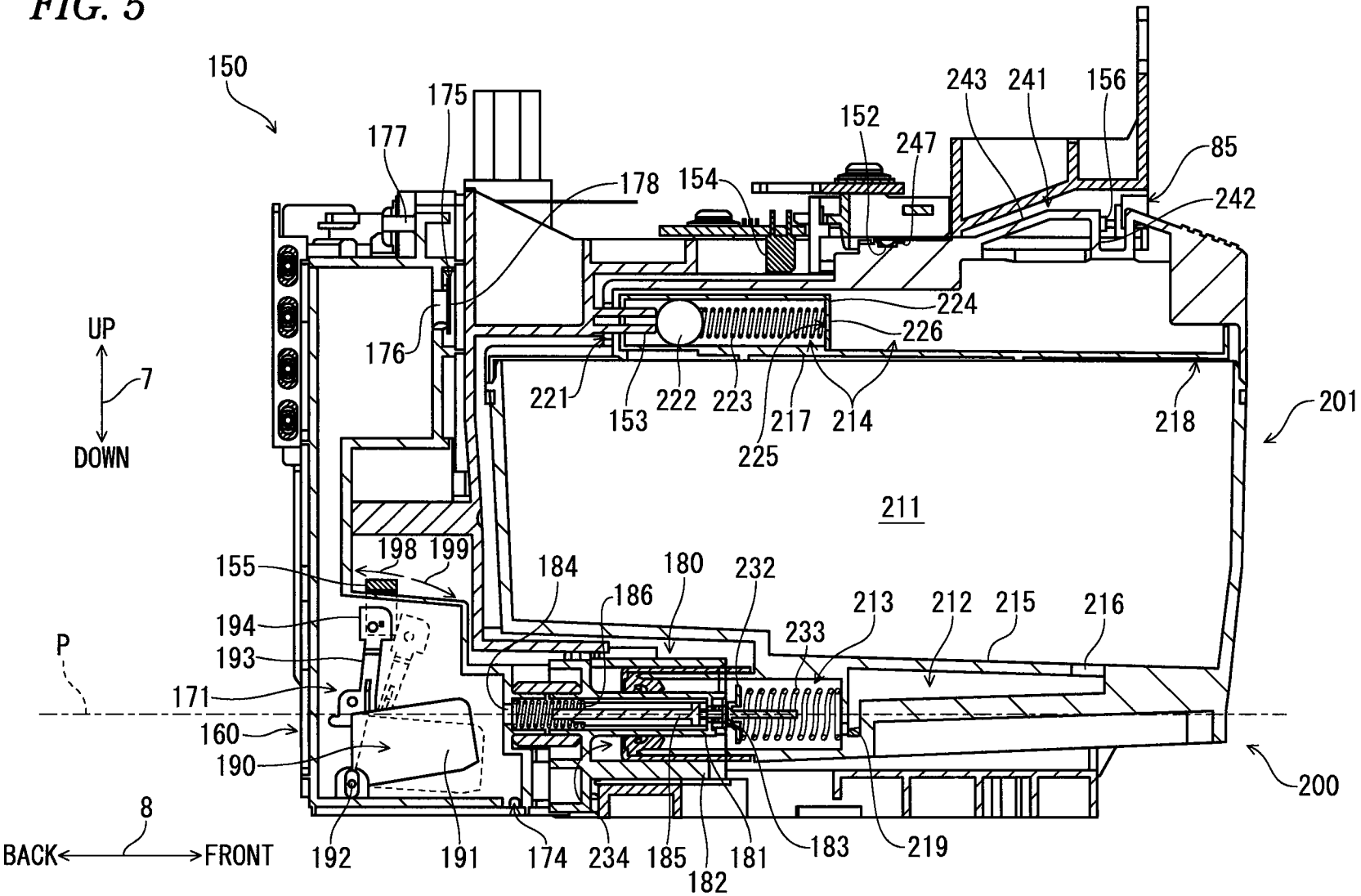
FIG. 5 is a longitudinal sectional view illustrating a state where the cartridge is installed in the installation case.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference through the connected supply tube 230 and the joint 180.

As illustrated in FIG. 4, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and back direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC substrate 247 is located on the outer surface of the upper wall 204 and between the light shielding rib 245 and the projection 241 in the front and back direction 8. On the IC substrate 247, an electrode 248 is formed. In addition, the IC substrate 247 includes a memory (not illustrated). The electrode 248 is electrically connected to the memory of the IC substrate 247. The electrode 248 is exposed on an upper surface of the IC substrate 247 so as to be electrically connectable with the contact 152. That is, the electrode 248 is electrically connected to the contact 152 in the state where the cartridge 200 is installed in the installation case 150. The controller 130 can read information from the memory of the IC substrate 247 through the contact 152 and the electrode 248, and can write information to the memory of the IC substrate 247 through the contact 152 and the electrode 248. The memory of the IC substrate 247 is an example of a cartridge memory.

The memory of the IC substrate 247 stores an initial ink amount Vc0, an ink amount Vc, and identification information for identifying the individual of the cartridge 200. The initial ink amount Vc0 indicates the amount of ink stored in the new cartridge 200. Hereinafter, information stored in the memory of the IC substrate 247 may be collectively referred to as "CTG information" in some cases. Further, the "new" is a so-called unused item and indicates a state in which the ink stored in the cartridge 200 has never flowed out from the cartridge 200 which is manufactured and sold. The initial cartridge is a cartridge having a state in which the ink does not flowed out from the liquid chamber 210. In the initial cartridge, the initial ink amount Vc0 is stored in the IC substrate 247.

[Controller 130]

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of a memory.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

Further, a display 17 and an operation panel 22 are connected to the ASIC 135. The display 17 is a liquid crystal display, an organic EL display, or the like, and includes a display screen on which various types of information are displayed. The display 17 is an example of an alarm or a notification device. However, specific examples of the alarm or the notification device are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display 17.

Further, the ASIC 135 is connected with the contact 152, the cover sensor 88, the installation sensor 154, and the liquid level sensor 155. The controller 130 accesses the memory of the IC substrate 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the predetermined position P.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, a function F, an initial process flag, thresholds T1, T2, and T3, and waiting times Tw1, Tw2, and Tw3. The time T1 is an example of the first time. The waiting time Tw1 is an example of the second time. The time T2 is an example of the third time.

The ink amount Vc and the identification information are information read by the controller 130 from the memory of the IC substrate 247 through the contact 152 in a state where the cartridge 200 is installed in the installation case 150. The function F may be stored in the ROM 132 instead of the EEPROM 134.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by the function F. The function F is information indicating a corresponding relation of the total amount Vt of ink, the ink amount Vc, and the ink amount Vc. The ink in the liquid chamber 210 of the cartridge 200 and the ink in the liquid chamber 171 of the tank 160 are in equilibrium in a state where positions in the vertical direction 7 of the liquid levels of the respective inks coincide with each other. That is, in the equilibrium state, the movement of the ink between the liquid chamber 210 and the liquid chamber 171 is stopped. For example, the relation between the total amount Vt of ink and the ink amount Vs can be approximated by the function F. Accordingly, when the total amount Vt of ink is calculated, the ink amount Vs and the ink amount Vc are obtained. The ink amount Vs and the ink amount Vc are not limited to the form of the function F, and may be obtained by a table correlated with the total amount Vt.

The initial process flag is information indicating whether the initial process is performed in the printer 10. In the initial process flag, a value "ON" corresponding to a state in which the initial process is performed and a value "OFF" corresponding to a state in which the initial process is performed are set. The initial process flag is set to "OFF" at the time of product shipment.

[Operation of Printer 10]

Figure 7:
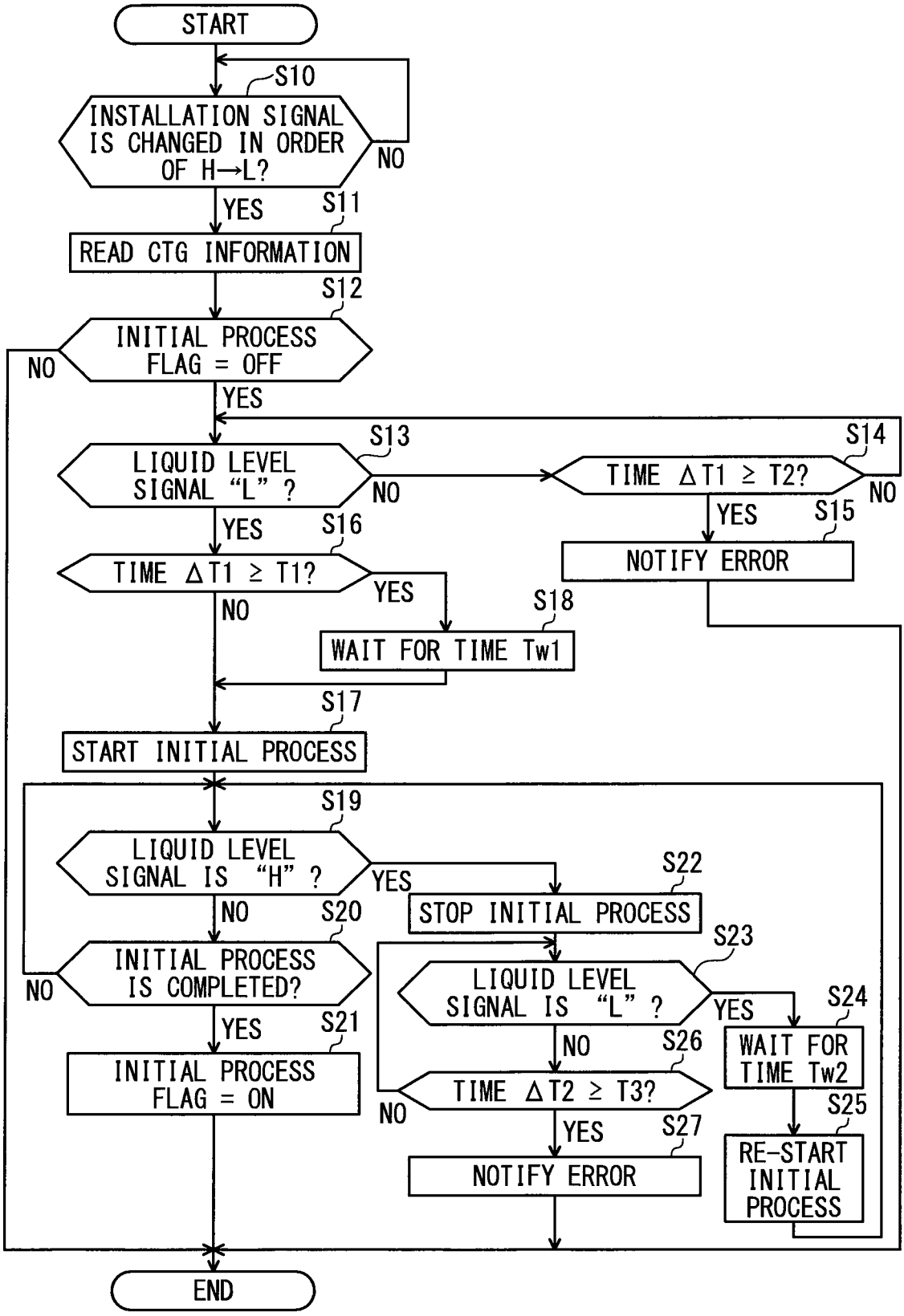
FIG. 7 is a flowchart of an initial process according to a first embodiment.

An operation of the printer 10 according to the embodiment will be described with reference to FIG. 7. An initial process illustrated in FIG. 7 is executed by the CPU 131 of the controller 130. Each of the following processes may be executed by the CPU 131 reading programs stored in the ROM 132, or may be implemented a hardware circuit installed in the controller 130. Further, execution orders of the following processes can be appropriately changed within the range of the gist of the invention.

Figure 8A:
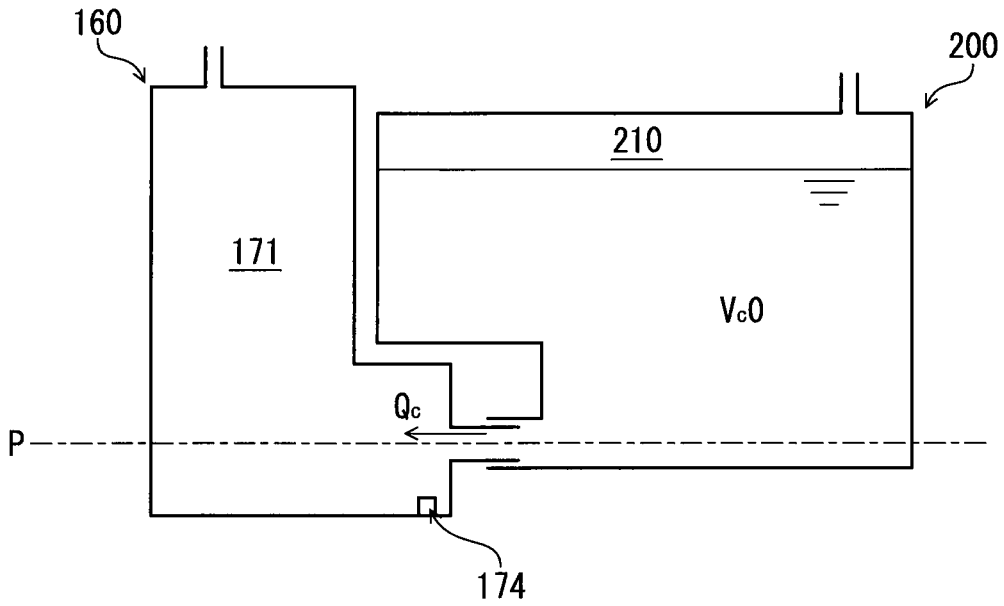
FIG. 8A is a schematic diagram of a state immediately after the cartridge is initially installed in the installation case.

The controller 130 executes the initial process when the cartridge 200 is first installed in the installation case 150 of the printer 10. As illustrated in FIG. 8A, in the unused printer 10, ink is not stored in the liquid chamber 171 of the tank 160. Further, there is no ink in the space from the outflow port 174 of the liquid chamber 171 to the tube 32 and the head 21, and air is present or a conservative solution different from the ink is filled. Therefore, when the printer 10 is used for the first time, it is necessary to execute an initial process of introducing ink from the liquid chamber 210 of the cartridge 200 installed in the installation case 150 to the tube 32 and the head 21 through the liquid chamber 171. For example, by sucking or discharging from the nozzle 29 of the head 21 with a pump or the like, the ink stored in the liquid chamber 210 is introduced into the tube 32 and the head 21 through the liquid chamber 171.

As illustrated in FIG. 7, the controller 130 acquires a high-level signal from the installation sensor 154 and then determines whether it has acquired a low-level signal from the installation sensor 154 (S10). Further, the controller 130 acquires the high-level signal from the time at which the cartridge 200 is first installed in the installation case 150, that is, the high-level signal from the installation sensor 154, and then stores the time in the EEPROM 134, in response to the acquisition of the high-level signal from the installation sensor 154 (S10: Yes).

Subsequently, the controller 130 reads the identification information or the CTG information such as the ink amount Vc0 from the IC substrate 247 of the cartridge 200 installed in the installation case 150 (S11). The readout CTG information is stored in the EEPROM 134.

Further, the controller 130 reads the initial processing flag of the EEPROM 134 (S12). If the initial process flag is "ON" (S12: No), the controller 130 terminates the initial process. If the initial process flag is "ON", the initial process has already been executed.

Figure 8B:
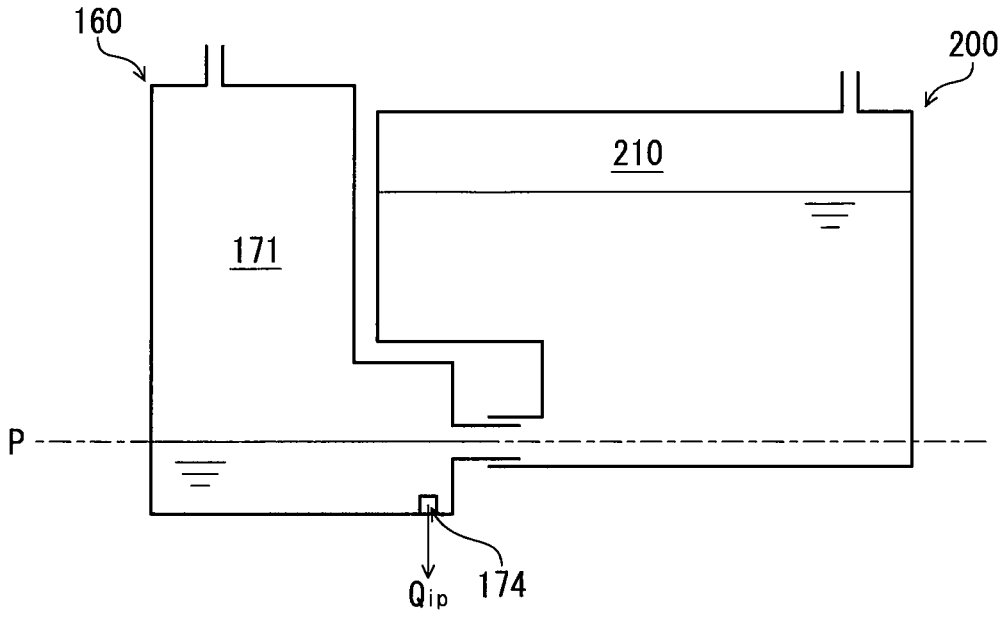
FIG. 8B is a diagram illustrating a state where the cartridge is initially installed in the installation case and a liquid level of ink in a liquid chamber reaches a predetermined position.

If the initial process flag is "OFF" (S12: Yes), the controller 130 determines whether the signal received from the liquid level sensor 155 is a low-level signal (S13). As illustrated in FIG. 8B, for example, when a new cartridge 200 is installed in the installation case 150, when the ink flows into the liquid chamber 171 from the liquid chamber 210, and if the time elapses after the liquid level of the ink reaches the predetermined position P in the chamber 171, and the liquid level sensor 155 outputs the low-level signal.

In response to determining that a low-level signal has not been received from the liquid level sensor 155 (S13: No), the controller 130 determines whether the time ΔT1 from the time when the low-level signal is received from the installation sensor 154 to the present time reaches the time T2 (S14). In response to determining that the time ΔT1 has not reached the time T2 (S14: No), the controller 130 executes S13. In response to determining that the time ΔT1 has reached the time T2 (S14: Yes), the controller 130 causes the display 17 to display a screen showing that the initial processing is an error (S15), and terminates the initial processing. The time T2 is set in advance as, for example, a time longer than a time T1 to be described later.

In response to receiving the low-level signal from the liquid level sensor 155 (S13: Yes), the controller 130 determines whether the time ΔT1 from the time when the low-level signal is received from the installation sensor 154 to the current time, that is, the time until receiving the low-level signal is equal to or greater than the time T1 (S16). In response to determining that the time ΔT1 is less than the time T1 (S16: No), the controller 130 starts the initial process operation (S17). That is, the suction operation through the nozzle 29 of the head 21 is started. The time ΔT1 is an example of the first elapsed time and the second elapsed time.

In response to determining that the time ΔT1 is equal to or longer than the time T1 (S16: Yes), the controller 130 waits for the time Tw1 (S18) and then starts the initial process operation (S17). Waiting for the time Tw1 is an example of the second elapsed time reaching the second time. For example, the time T1 is set such that, after the cartridge 200 in which the ink with the initial ink amount Vc0 is stored in the liquid chamber 210 is installed in the installation case 150, the ink flows out from the liquid chamber 210 to the empty liquid chamber 171, and the time is longer than the time required for the position of the liquid level of the chamber 171 to reach the predetermined position P in advance. When the time ΔT1 is equal to or longer than the time T1, the speed (flow rate Qc) at which the ink flows out from the liquid chamber 210 of the cartridge 200 to the liquid chamber 171 of the tank 160 is delayed due to a cause such as outflow failure, and it is estimated that it takes longer time than usual. Therefore, the flow rate Qc of the ink to the liquid chamber 171 after the initial process operation is started is also smaller than usual. In such a state, after the liquid level of the liquid chamber 171 has reached the predetermined position P, by waiting for the time Tw1, a sufficient amount of ink is stored in the liquid chamber 171, and even the initial process operation is executed at a predetermined flow rate Qip after that, it is possible to prevent the liquid level of the liquid chamber 171 from reaching the vicinity of the outlet port 174. In the designing stage, when the cartridge 200 in which the ink of the initial ink amount Vc0 is stored in the liquid chamber 210 is mounted at the reference environment (temperature, humidity, etc.), after the liquid level sensor 155 outputs a low-level signal, the initial process operation is set so that the flow rate (flow rate Qc) at which ink flows out from the liquid chamber of the cartridge 200 to the liquid chamber 171 of the tank 160 is faster than the speed at which the ink flows out from the liquid chamber 171 to the tank 160 by the initial process operation.

After starting the initial process operation, the controller 130 determines whether a high-level signal has been received from the liquid level sensor 155 (S19). If the controller 130 determines that the initial process operation has ended (S20: Yes) without receiving the high-level signal from the liquid level sensor 155 (S19: No), the controller 130 sets the initial processing flag stored in the EEPROM 134 to "ON" (S21), and terminates the initial process.

After starting the initial process operation, the controller 130 stops the initial process operation (S22) in response to determining that the high-level signal has been received from the liquid level sensor 155 (S19: Yes). Further, the controller 130 stores the time at which the high-level signal is received from the liquid level sensor 155 in the RAM 133. Further, the controller 130 determines whether a low-level signal has been received from the liquid level sensor 155 (S23).

The ink flows out from the liquid chamber 171 to the tube 32 and the head 21 by the initial process operation. On the other hand, ink flows into the liquid chamber 171 from the liquid chamber 210 of the cartridge 200. If the amount of ink flowing out from the liquid chamber 171 becomes larger than the amount of ink flowing into the liquid chamber 171, the liquid level of the liquid chamber 171 may descend and become less than the predetermined position P in some cases. When the liquid level of the liquid chamber 171 becomes less than the predetermined position P, the liquid level sensor 155 outputs a high-level signal. When the state in which the amount of ink flowing out from the liquid chamber 171 is larger than the amount of ink flowing into the liquid chamber 171 continues, since there is a risk in which the liquid level of the liquid chamber 171 may reach the vicinity immediately above the outflow port 174, the operation is temporarily stopped, and waiting for the liquid level of the liquid chamber 171 to rise is awaited.

In response to receiving the low-level signal from the liquid level sensor 155 (S23: Yes), the controller 130 waits for the time Tw2 (S24), and resumes the stopped initial process operation (S25). Since the liquid level of the liquid chamber 171 descends by the initial process operation, after the liquid level of the liquid chamber 171 has reached the predetermined position P, by waiting for the time Tw2, it is possible to store a sufficient amount of ink in the liquid chamber 171. Then, the controller 130 executes S19.

In response to determining that a low-level signal has not been received from the liquid level sensor 155 (S23: No), the controller 130 determines whether or not the time ΔT2 from the time when the high-level signal is received from the installation sensor 154 (time of S19: Yes) to the current time has reached a time T3 (S26). In response to determining that the time ΔT2 has not reached the time T3 (S26: No), the controller 130 executes S19. In response to determining that the time ΔT2 has reached the time T3 (S26: Yes), the controller 130 causes the display 17 to display a screen showing that the initial processing is an error (S27), and terminates the initial processing. The time T3 is set in advance as, for example, a time longer than a time T1 to be described later.

Operational Effect of First Embodiment

According to the first embodiment, since the initial process operation is started in response to reception of the low-level signal from the liquid level sensor 155 after the cartridge 200 is installed in the installation case 150, air cannot enter the tube from the liquid chamber 171, and the time until the initial process operation is started can be shortened.

Further, due to poor ink flow from the liquid chamber 210 to the liquid chamber 171, while the initial process operation is being performed, when the liquid level of the liquid chamber 171 becomes less than the predetermined position P and the liquid level sensor 155, the initial process operation is stopped, and air is prevented from entering the tube 32 from the liquid chamber 171.

Further, when the flow rate Qc of ink from the liquid chamber 210 to the liquid chamber 171 is small, by delaying the timing of starting the initial process operation by waiting the time Tw1 after the cartridge 200 is installed in the installation case 150, the timing of starting the initial process operation can be delayed. As a result, air is prevented from entering the tube 32 from the liquid chamber 171.

Further, when the flow rate Qc of ink from the liquid chamber 210 to the liquid chamber 171 is further small, there is an abnormality in the initial processing through the display 17, for example, there is an abnormality in the flow of ink from the liquid chamber 210 to the liquid chamber 171.

Second Embodiment

Hereinafter, the second embodiment will be described. The printer according to the second embodiment does not include the liquid level sensor 155 in the printer 10 according to the first embodiment, and is provided with a temperature sensor. The temperature sensor outputs an electric signal corresponding to the environmental temperature at which the printer is set to the controller 130. Further, in the EEPROM 134, a threshold C0 for a predetermined temperature and times T4 and T5 set as a waiting time Tk are stored. The time T4 is an example of the fourth time. The time T5 is an example of the fifth time. In the second embodiment, an initial process different from that in the first embodiment is executed. Since the configuration of the other printers is the same as that of the printer 10 according to the first embodiment, a detailed description thereof will not be provided.

Figure 9:
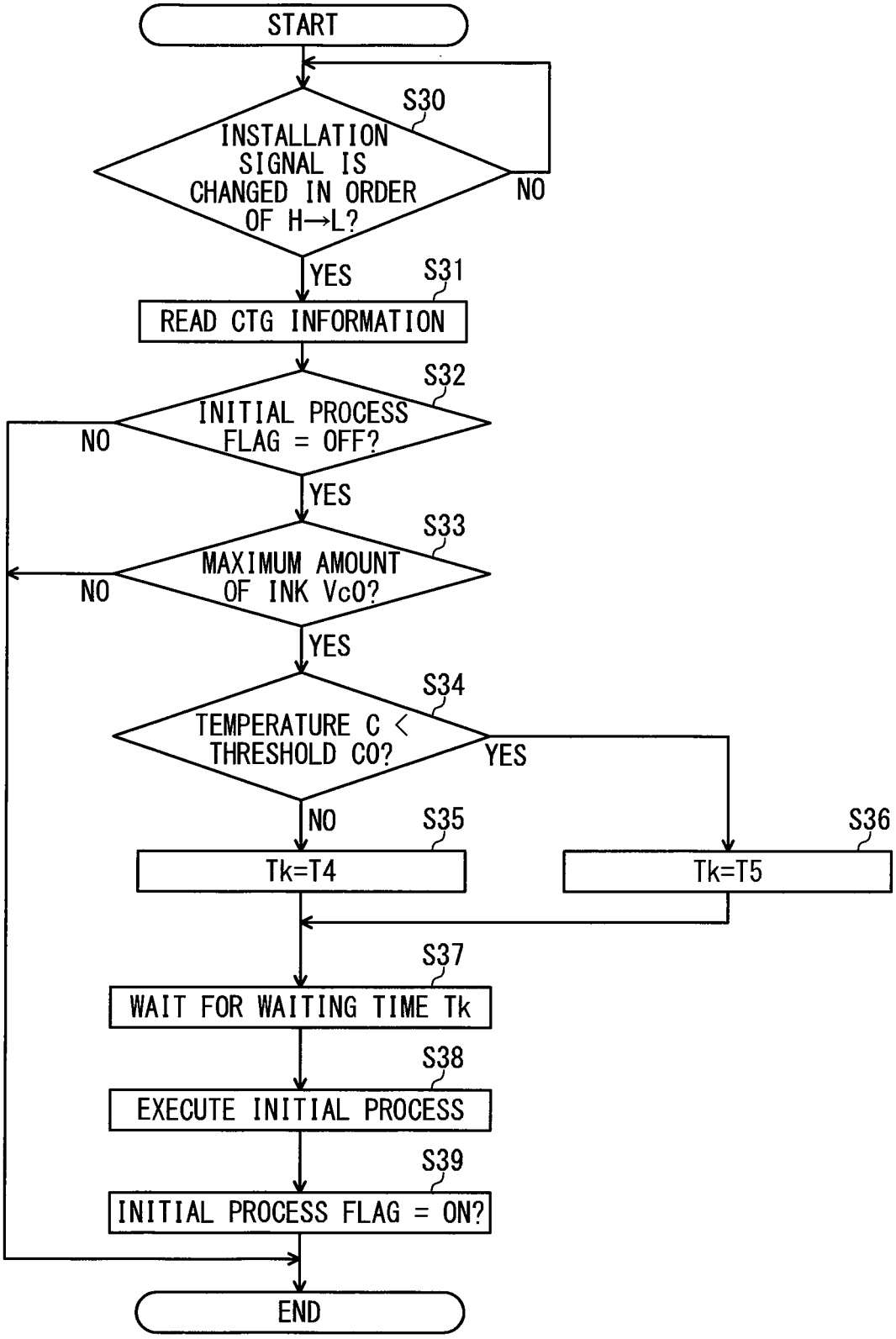
FIG. 9 is a flowchart of an initial process according to a second embodiment.

As in the first embodiment, the controller 130 executes the initial process when the cartridge 200 is first installed in the installation case 150 of the printer 10. As illustrated in FIG. 9, the controller 130 acquires a high-level signal from the installation sensor 154 and then determines whether it has acquired a low-level signal from the installation sensor 154 (S30).

Subsequently, the controller 130 reads the identification information and the CTG information such as the ink amount Vc0 from the IC substrate 247 of the cartridge 200 installed in the installation case 150 (S31). The readout CTG information is stored in the EEPROM 134.

Further, the controller 130 reads the initial processing flag of the EEPROM 134 (S22). If the initial process flag is "ON" (S22: No), the controller 130 terminates the initial process. If the initial process flag is "ON", the initial process has already been executed.

If the initial process flag is "OFF" (S22: Yes), the controller 130 determines whether or not the initial ink amount Vc0 has been read from the CTG information (S33). The initial ink amount Vc0 is stored in the memory of the IC substrate 247 of the new cartridge 200. When the cartridge 200 is used, for example, after the cartridge 200 is installed in the installation case 150, when discharging of ink through the head 21 such as image recording or purging is executed, the controller 130 erases the initial ink amount Vc0 stored in the memory of the IC substrate 247. Therefore, the cartridge 200 from which the controller 130 reads the initial ink amount Vc0 is a new cartridge. Further, in place of the initial ink amount Vc0, a value or information such as a flag indicating that the cartridge is a new cartridge is stored in the CTG information, and the controller 130 may read the value and the information to determine whether there is a new ink cartridge.

In response to determining that the initial ink amount Vc0 cannot be read out from the memory of the IC substrate 247 (S33: No), the controller 130 terminates the initial process. When a new cartridge 200 is installed in the installation case 150, ink flows into the liquid chamber 171 from the liquid chamber 210. The flow rate Qc at that time is the fastest among similar types of cartridges because the water head difference, which is the difference between the liquid level of the liquid chamber 171 of the tank 160 and the liquid level of the liquid chamber 210 of the cartridge 200, is the maximum. However, when the cartridge 200 which has already been used and the amount of ink stored in the liquid chamber 210 is smaller than the initial ink amount Vc0 is installed in the installation case 150, the flow rate Qc decreases as the head difference becomes smaller. As a result, there is a risk in which the flow rate Qc may be smaller than the flow rate Qip of the ink flowing out from the liquid chamber 171 in the initial process operation. If the flow rate Qc is less than the flow rate Qip, the liquid level of the liquid chamber 171 descends during the initial process operation, and there is a fear that the liquid level of the liquid chamber 171 will come to the vicinity of the outflow port 174. Therefore, when the cartridge 200 which is not a new cartridge is installed in the installation case 150, the initial process operation is not executed.

In response to reading the initial ink amount Vc0 from the memory of the IC substrate 247 (S33: Yes), the controller 130 determines whether the temperature output from the temperature sensor is less than the threshold C0 (S34). In response to determining that the temperature output from the temperature sensor is equal to or higher than the threshold C0 (S34: No), the controller 130 sets the time T4 to the waiting time Tk (S35). On the other hand, in response to determining that the temperature output by the temperature sensor is less than the threshold C0 (S34: Yes), the controller 130 sets the time T5 to the waiting time Tk. The time T5 is longer than the time T4.

If the environmental temperature at which the printer 10 is installed is low, it is estimated that the temperature of the ink stored in the cartridge 200 installed in the installation case 150 is also low. The viscosity of the ink increases as the temperature decreases. Therefore, as the ambient temperature decreases, the flow rate Qc of the ink from the liquid chamber 210 to the liquid chamber 171 tends to decrease. Therefore, if the temperature C is less than the threshold C0, the time T5 longer than the time T4 becomes the waiting time Tk.

Further, the controller 130 waits for the waiting time Tk (S37) and then executes the initial process operation (S38). While waiting for the waiting time Tk, ink flows out from the liquid chamber 210 of the cartridge 200 to the liquid chamber 171 of the tank 160, and the amount of ink stored in the liquid chamber 171 increases. As the waiting time Tk increases, the amount of ink stored in the liquid chamber 171 increases.

After executing the initial process operation, the controller 130 puts "ON" into the initial processing flag stored in the EEPROM 134 (S39) and terminates the initial processing.

Operational Effect of Second Embodiment

According to the second embodiment, since the initial process operation is executed when the waiting time Tk elapses after the cartridge 200 is installed in the installation case 150, air does not enter the tube 32 from the liquid chamber 171, and it is possible to shorten the time until the processing operation is executed.

Further, if the flow rate Qc from the liquid chamber 210 to the liquid chamber 171 decreases due to the low environmental temperature at which the printer 10 is installed and the viscosity of the ink is high, after the cartridge 200 is installed in the installation case 150, since the time T5 which is longer than the time T4 is set as the waiting time Tk until the processing operation is executed, the timing at which the initial process operation is executed is delayed. As a result, in the initial process operation, air is prevented from entering the tube 32 from the liquid chamber 171.

Further, when the cartridge 200 which does not store the ink of the initial ink amount Vc0 is installed in the installation case 150, since the initial process operation is not executed, air is prevented from entering the tube 32 from the liquid chamber 171.

Third Embodiment

Hereinafter, a third embodiment will be described. The printer according to the third embodiment does not include the liquid level sensor 155 similarly to the printer according to the second embodiment. Further, in the EEPROM 134, a flow rate Qip (an example of the first threshold) as a threshold, an execution time Tip of the initial process operation, a threshold Vth1 (an example of the second threshold), a function indicating the relationship between the ink amount Vc and the flow rate Qc or a table is stored. In the third embodiment, initial processing different from the first embodiment and the second embodiment is executed. Since the configuration of the other printers is the same as that of the printer 10 according to the first embodiment, a detailed description thereof will not be provided.

Figure 10:
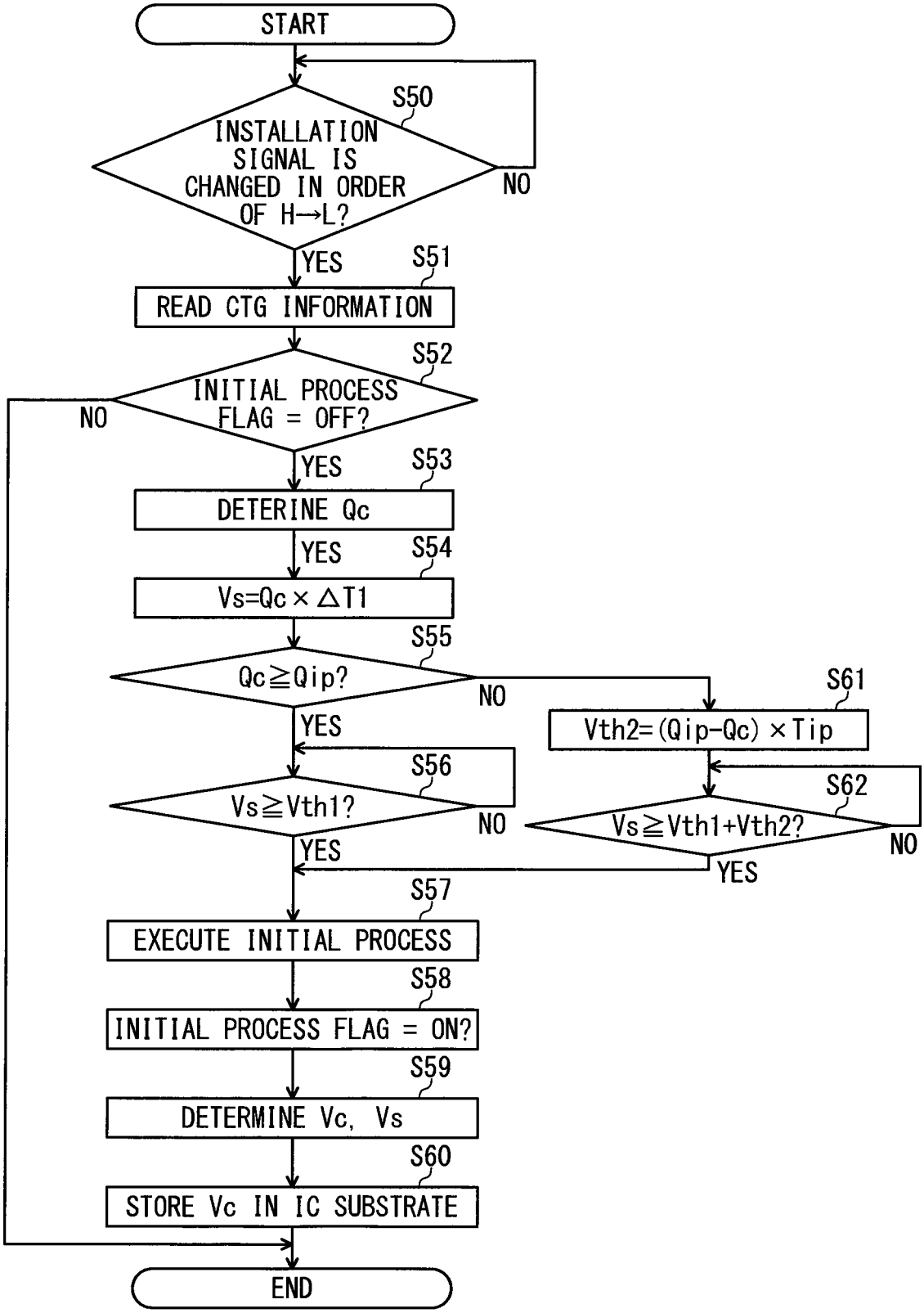
FIG. 10 is a flowchart of an initial process according to a third embodiment.

As in the first embodiment, the controller 130 executes the initial process when the cartridge 200 is first installed in the installation case 150 of the printer 10. As illustrated in FIG. 10, the controller 130 determines whether a high-level signal is acquired from the installation sensor 154 and thereafter a low-level signal is acquired from the installation sensor 154 (S50). Then, the controller 130 acquires the time at which the cartridge 200 is initially installed in the installation case 150, that is, a high-level signal from the installation sensor 154, and thereafter stores the time is stored in the EEPROM 134 in response to acquiring a low-level signal from the installation sensor 154 (S50: Yes).

Subsequently, the controller 130 reads the CTG information such as the identification information, the initial ink amount Vc0, the ink amount Vc and the like from the IC substrate 247 of the cartridge 200 installed in the installation case 150 (S51). The readout CTG information is stored in the EEPROM 134.

Further, the controller 130 reads the initial process flag of the EEPROM 134 (S52). If the initial process flag is "ON" (S52: No), the controller 130 terminates the initial process. If the initial process flag is "ON", the initial process has already been executed.

If the initial processing flag is "OFF" (S52: Yes), the controller 130 determines the flow rate Qc from the ink amount Vc or the initial ink amount Vc0 included in the CTG information (S53), and the initial ink amount Vc0 is stored in the memory of the IC substrate 247 of the new cartridge 200. Further, when the cartridge 200 is used, for example, after the cartridge 200 is installed in the installation case 150, when discharging of ink through the head 21 such as image recording or purging is executed, the controller 130 controls the IC substrate 247 (an example of the first value) stored in the memory of the IC substrate 247, and stores the currently stored ink amount Vc (an example of the second value) in the memory of the IC substrate 247. Instead of the initial ink amount Vc0, a value or information such as a flag indicating that the cartridge is a new cartridge is stored in the CTG information, and the controller 130 reads the value and the information and reads the initial ink amount previously stored in the EEPROM 134, thereby determining the amount of ink stored in the cartridge 200.

The flow rate Qc of the ink from the liquid chamber 210 to the liquid chamber 171 after the cartridge 200 is installed in the installation case 150 varies depending on the difference between the height of the liquid level of the liquid chamber 210 from the reference position (for example, the predetermined position P) and the height of the liquid level of the liquid level 171, that is, the water head difference. Before the initial process operation, since the ink is not stored in the liquid chamber 171, the flow rate Qc depends on the height of the liquid level of the liquid chamber 210, that is, the ink amount Vc. Therefore, if a function or table showing the relationship between the ink amount Vc and the flow rate Qc is stored in the EEPROM 134, the flow rate Qc can be determined on the basis of the ink amount Vc or the initial ink amount Vc0 read from the IC substrate 247.

Subsequently, the controller 130 calculates the ink amount Vs stored in the liquid chamber 171 by multiplying the determined flow rate Qc by the time ΔT1 from the time of receiving the low-level signal from the installation sensor 154 to the present time (S54). Then, in response to determining that the determined flow rate Qc is equal to or greater than the threshold flow rate Qip (S55: Yes), the controller 130 determines whether the calculated ink amount Vs is not less than the threshold Vth1 (S56). If the controller 130 determines that the calculated ink amount Vs is less than the threshold Vth1 (S56: No), the controller 130 repeats S56 at predetermined time intervals. Since the calculated ink amount Vs increases as the current time becomes later, it eventually becomes equal to or larger than the threshold Vth1 (S56: Yes). In response to determining that the ink amount Vs is equal to or greater than the threshold Vth1 (S56: Yes), the controller 130 starts an initial process operation (S57).

After executing the initial process operation, the controller 130 puts "ON" into the initial processing flag stored in the EEPROM 134 (S58). Then, the ink amounts Vc and Vs after the initial process operation are calculated and stored in the EEPROM 134 (S59). Further, the calculated ink amount Vc is stored in the memory of the IC substrate 247 (S60), and the initial process is terminated.

In S55, in response to determining that the flow rate Qc is less than the flow rate Qip (S55: No), the controller 130 calculates a threshold Vth2 (an example of a third threshold) (S61). The threshold Vth2 is calculated as a value obtained by multiplying the difference between the flow rate Qip and the flow rate Qc by the time Tip for executing the initial process operation. If the flow rate Qc is less than the flow rate Qip, the amount of ink stored in the liquid chamber 171 decreases while the initial process operation is executed. The difference between the flow rate Qip and the flow rate Qc corresponds to the ink amount decreasing from the liquid chamber 171 per unit time in the initial process operation. The value obtained by multiplying this by the time Tip corresponds to the total amount of ink which decreases from the liquid chamber 171 in the initial process operation.

The controller 130 determines whether the calculated ink amount Vs is equal to or greater than a sum of the threshold Vth1 and the threshold Vth2 (S62). If the controller 130 determines that the calculated ink amount Vs is less than the sum of the threshold Vth1 and the threshold Vth2 (S62: No), the controller 130 repeats S62 at predetermined time intervals. Since the calculated ink amount Vs increases as the current time becomes later, it finally becomes equal to or larger than the threshold Vth2 (S62: Yes). Then, in response to determining that the ink amount Vs is equal to or greater than the sum of the threshold Vth1 and the threshold Vth2 (S62: Yes), the controller 130 starts the initial process operation (S57), and executes the processes S58 to S60.

Operational Effect of Third Embodiment

According to the third embodiment, if the flow rate Qc is equal to or higher than the flow rate Qip after the cartridge 200 is installed in the installation case 150, and if the ink amount Vs becomes equal to or larger than Vth1, the initial process operation is executed. As a result, it is possible to shorten the time required for the initial process operation to be executed without air entering from the liquid chamber 171 to the tube 32.

If the flow rate Qipc is less than the flow rate Qip, the initial process operation is executed when the ink amount Vs becomes larger than the value obtained by adding the threshold Vth2 to the threshold Vth1. Therefore, according to the flow rate Qc, it is possible to shorten the time from the installing of the cartridge 200 to the installation case 150 until the initial process operation is executed.

Modified Example

In the above embodiment, the discharge of ink through the head 21 is described as image recording on a sheet. However, the discharge of ink through the head 21 may be a so-called purge which forcibly discharges the ink from the nozzle 29 of the head 21.

Further, in the above-described embodiment, the controller 130 detects whether or not the detected portion 194 of the actuator 190 is located at the detection position based on the signal output from the liquid level sensor 15. However, if the liquid level of ink in the liquid chamber 171 can be detected, the configuration of the liquid level sensor 155 is not particularly limited. For example, the controller 130 may be a sensor for optically detecting the liquid level of the ink in the liquid chamber 171, by utilizing a prism having a different reflectance depending on whether ink is in contact with the rear wall 164 of the liquid chamber 171. Further, the liquid level sensor 155 may be an electrode rod inserted in the liquid chamber 171.

In the above-described embodiment, the controller 130 executes the process illustrated in step S15 in response to acquiring the low-level signal from the installation sensor 154, then acquiring the high-level signal from the installation sensor 154, and further acquiring the low-level signal from the installation sensor 154 (S14: Yes). The controller 130 executes the process illustrated in step S15 when the cartridge 200 is mounted in the installation case 150 in which the cartridge 200 is not present in the installation case 150. That is, the controller 130 may execute the process illustrated in step S15 when it is determined that the cartridge 200 is mounted in the installation case 150. The fact that the controller acquires the low-level signal from the installation sensor 154, then acquires the high-level signal from the installation sensor 154, and further acquires the low-level signal from the installation sensor 154 is an example in which the controller 130 determines that the cartridge is mounted in the installation case 150. Other examples in which the controller 130 determines that the cartridge 200 is mounted in the installation case 150 will be described below.

For example, the controller 130 receives the low-level signal after receiving the high-level signal from the cover sensor 88. Then, the controller 130 reads the identification information from the memory of the IC substrate 247 and compares the read identification information with the identification information of the cartridge 200 before exchange stored in the EEPROM 134. When it is determined that the identification information read from the memory of the IC substrate 247 and the identification information stored in the EEPROM 134 are different from each other, the controller 130 may execute the process illustrated in step S15. That is, "the controller 130 reads identification information from the memory of the IC substrate 247 and compares the read identification information with the identification information of the cartridge 200 before exchange stored in the EEPROM 134. As a result, it is determined that the identification information read from the memory of the IC substrate 247 and the identification information stored in the EEPROM 134 are different from each other" is an example in which the controller 130 determines that the cartridge 200 is mounted in the installation case 150. In this case, the controller 130 reads the identification information from the memory of the IC substrate 247, compares the read identification information with the identification information of the cartridge 200 before exchange stored in the EEPROM 134, and stores the time when it is determined that the identification information read from the memory of the IC substrate 247 and the identification information stored in the EEPROM 134 are different from each other in the EEPROM as the time to be stored the identification information in step S15. Alternately, the time when the controller receives the low-level signal after receiving the high-level signal from the cover sensor 88 may be stored in the EEPROM in step S15.

For example, the controller 130 receives the low-level signal after receiving the high-level signal from the cover sensor 88. Then, the controller 130 causes the user to display a confirmation screen indicating whether or not a new cartridge 200 is mounted in the installation case 150 through the display 17. The controller 130 receives an input corresponding to the confirmation screen through the operation panel 22 while the confirmation screen is being displayed on the display 17. The controller 130 executes the process illustrated in step S15 when the received input corresponds to the installing of a new cartridge 200 in the installation case 150. That is, "the controller 130 receives the low-level signal after receiving the high-level signal from the cover sensor 88. Then, the controller 130 causes the user to display a confirmation screen indicating whether or not a new cartridge 200 is mounted in the installation case 150 through the display 17. The controller 130 receives an input corresponding to the confirmation screen through the operation panel 22 while the confirmation screen is being displayed on the display 17. The received input corresponds to the installing of a new cartridge 200 in the installation case 150" is an example in which the controller 130 determines that the cartridge 200 is mounted in the installation case 150. In this case, the controller 130 stores the time when the input corresponding to the confirmation screen is received through the operational panel 22 in the EEPROM as the time to be stored in step S15.

Furthermore, in the embodiment described above, the ink is an example of liquid. However, the liquid, for example, may be pretreatment liquid discharged to a paper and the like prior to ink at the time of image recording, or may be water for cleaning the head 21.

According to the present disclosure, at least the following modes are provided.

(1) A liquid discharge device may include: an installation case configured to receive a cartridge, the cartridge including: a first liquid chamber in which a liquid is stored; a first flow path, one end of the first flow path being communicated with the first liquid chamber, the other end of the first flow path being communicated with the outside of the cartridge; and a second flow path, one end of the second flow path being communicated with the first liquid chamber, the other end of the second flow path being communicated with the outside of the cartridge; a tank including: a second liquid chamber; a third flow path, one end of the third flow path being communicated with the outside of the cartridge, the other end of the third flow path being communicated with the second liquid chamber, at least one of the first flow path and the third flow path being configured to communicate with the first liquid chamber of the cartridge installed in the installation case and the second liquid chamber; a fourth flow path, one end of the fourth flow path being located below the third flow path communicates with the second liquid chamber; and a fifth flow path, one end of the fifth flow path being communicated with the second liquid chamber, the other end of the fifth flow path being communicated with the outside of the cartridge; a head that is communicated with the other end of the fourth flow path; a liquid level sensor; and a controller. The controller is configured to: receive a first signal from the liquid level sensor in a case where a position of a liquid level in the second liquid chamber is equal to or higher than a predetermined position; receive a second signal from the liquid level sensor in a case where the position of the liquid level in the second liquid chamber is lower than the predetermined position; determine that the cartridge is installed in the installation case; and based on determining that the first signal is received from the liquid level sensor after receiving the second signal based on determining that the cartridge is installed in the installation case, execute an initial process of introducing the liquid stored in the first liquid chamber to the head and the fourth flow path.

According to the above configuration, it is possible to shorten the time until the initial process is executed without entering the air from the second liquid chamber to the fourth flow path after the cartridge is installed in the installation case.

(2) Preferably, the controller is configured to: based on determined that the second signal is received from the liquid level sensor while executing the initial process, suspend the initial process; and based on determined that the first signal is received from the liquid level sensor after suspending the initial process, execute the suspended initial process.

According to the above configuration, when the liquid level of the second liquid chamber becomes lower than the predetermined position while the initial process is executed due to poor liquid flow from the first liquid chamber to the second liquid chamber, the initial process is interrupted and the air is prevented from entering the fourth flow path from the second liquid chamber.

(3) Preferably, the controller is configured not to, in a case where a first elapsed time reaches a first time, the first elapsed time being a time period from a time point at which being determining that the cartridge is installed in the installation case until a time point at which the first signal is received from the liquid level sensor, execute the initial process, and wherein the controller is configured to, in a case where a second elapsed time reaches a second time, the second elapsed time being a time period after the first signal is received from the liquid level sensor, execute the initial process.

According to the above configuration, when the flow rate of the liquid from the first liquid chamber to the second liquid chamber is small, it is possible to delay the timing of starting the initial process after the cartridge is installed in the installation case. Thus, the air is prevented from entering the fourth flow path from the second liquid chamber.

(4) Preferably, the liquid discharge device further includes an alarm, wherein the controller is configured to, based on receiving the second signal from the liquid level sensor without receiving the first signal in a case where a third elapsed time reaches a third time longer than the first time, control the alarm to activate, the third elapsed time being a time period from a time point at which the controller determines that the cartridge is installed in the installation case.

According to the above configuration, when the flow rate of the liquid from the first liquid chamber to the second liquid chamber is further small, the user is notified that there is an abnormality in the inflow of the liquid from the first liquid chamber to the second liquid chamber.

(5) Preferably, the liquid discharge device further includes a memory, wherein the controller is configured to: on a condition that a first value corresponding to the fact that the initial process is not executed is read out from the memory, execute the initial process; and based on completion of the initial process, update the first value to a second value corresponding to the fact that the initial process is executed.

According to the above configuration, it is possible to shorten the time until the initial process for flowing the liquid from the second liquid chamber into the head is executed from when the cartridge is installed in the installation case, without entering the air from the second liquid chamber to the head.

(6) A liquid discharge device may include: an installation case configured to receive a cartridge, the cartridge including: a first liquid chamber in which a liquid is stored; a first flow path, one end of the first flow path being communicated with the first liquid chamber, the other end of the first flow path being communicated with the outside of the cartridge; and a second flow path, one end of the second flow path being communicated with the first liquid chamber, the other end of the second flow path being communicated with the outside of the cartridge; a tank including: a second liquid chamber; a third flow path, one end of the third flow path being communicated with the outside of the cartridge, the other end of the third flow path being communicated with the second liquid chamber, at least one of the first flow path and the third flow path being configured to communicate with the first liquid chamber of the cartridge installed in the installation case and the second liquid chamber; a fourth flow path, one end of the fourth flow path being located below the third flow path communicates with the second liquid chamber; and a fifth flow path, one end of the fifth flow path being communicated with the second liquid chamber, the other end of the fifth flow path being communicated with the outside of the cartridge; a head that is communicated with the other end of the fourth flow path; and a controller. The controller is configured to: determine that the cartridge is installed in the installation case; and in a case where an elapsed time from a time point at which being determined that the cartridge is installed in the installation sensor reaches a fourth time, execute an initial process of introducing the liquid stored in the first liquid chamber to the head and the fourth flow path.

According to the above configuration, it is possible to shorten the time until the initial process is executed without entering the air from the second liquid chamber to the fourth flow path after the cartridge is installed in the installation case.

(7) Preferably, the liquid discharge device further includes a temperature sensor, wherein the controller is configured to: in a case where a temperature determined from a signal received from the temperature sensor is lower than a predetermined temperature, set a fifth time instead of the fourth time, the fifth time being longer than the fourth time; and execute the initial process based on determining that the elapsed time reaches the fifth time.

According to the above configuration, when the flow rate from the first liquid chamber to the second liquid chamber decreases due to the low temperature and the high viscosity, the timing of executing the initial process is delayed after the cartridge is installed in the installation case, and thus the air is prevented from entering the fourth flow path from the second liquid chamber.

(8) Preferably, the liquid discharge device further includes an interface, wherein the controller is configured to, on a condition that identification information indicating that an initial volume of liquid is stored in the first liquid chamber is read from a memory of the cartridge through the interface, execute the initial process. According to the above configuration, when the cartridge not storing the initial volume of liquid is installed in the installation case, the initial process is not executed, and thus the air is prevented from entering the fourth flow path from the second liquid chamber.

(9) Preferably, a memory, wherein the controller is configured to: on a condition that a first value corresponding to the fact that the initial process is not executed is read out from the memory, execute the initial process; and based on completion of the initial process, update the first value to a second value corresponding to the fact that the initial process is executed.

According to the above configuration, it is possible to shorten the time until the initial process for flowing the liquid from the second liquid chamber into the head is executed from when the cartridge is installed in the installation case, without entering the air from the second liquid chamber to the head.

(10) A liquid discharge device may include: an installation case configured to receive a cartridge, the cartridge including: a first liquid chamber in which a liquid is stored; a first flow path, one end of the first flow path being communicated with the first liquid chamber, the other end of the first flow path being communicated with the outside of the cartridge; and a second flow path, one end of the second flow path being communicated with the first liquid chamber, the other end of the second flow path being communicated with the outside of the cartridge; a tank including: a second liquid chamber; a third flow path, one end of the third flow path being communicated with the outside of the cartridge, the other end of the third flow path being communicated with the second liquid chamber, at least one of the first flow path and the third flow path being configured to communicate with the first liquid chamber of the cartridge installed in the installation case and the second liquid chamber; a fourth flow path, one end of the fourth flow path being located below the third flow path communicates with the second liquid chamber; and a fifth flow path, one end of the fifth flow path being communicated with the second liquid chamber, the other end of the fifth flow path being communicated with the outside of the cartridge; a head that communicates with the other end of the fourth flow path; an interface; and a controller. The controller is configured to: determine that the cartridge is installed in the installation case; after determining that the cartridge is installed in the installation case, read a liquid amount Vc of a liquid stored in the first liquid chamber from a memory of the cartridge through the interface; based on the read liquid amount Vc, determine a flow rate Qc at which the liquid flows from the first liquid chamber to the second liquid chamber; calculate a liquid amount Vs of a liquid stored in the second liquid chamber by multiplying the flow rate Qc by an elapsed time from a time point at which being determined that the cartridge is installed in the installation case; and based on the flow rate Qc is equal to or larger than a first threshold and the liquid amount Vs is equal to larger than a second threshold, execute an initial process of introducing the liquid stored in the first liquid chamber to the head and the fourth flow path.

According to the above configuration, it is possible to shorten the time until the initial process is executed without entering the air from the second liquid chamber to the fourth flow path after the cartridge is installed in the installation case.

(11) Preferably, the controller is configured to: on a condition that the flow rate Qc is less than the first threshold, calculate a third threshold obtained by adding a liquid amount Vth to the second threshold, the liquid amount being obtained by multiplying a difference between the first threshold and the flow rate Qc by a time period for which the initial process is to be executed, and in a case where the liquid amount Vs is equal to or larger than the third threshold, execute the initial process of discharging the liquid through the head or the fourth flow path.

According to the above configuration, according to the flow rate Qc, it is possible to shorten the time until the initial process is executed from when the cartridge is installed in the installation case.

(12) Preferably, the controller is configured to: read the liquid amount Vc of the liquid stored in the first liquid chamber from the cartridge memory through the interface; based on the read liquid amount Vc, determine the liquid amount Vc of the liquid stored in the first liquid chamber and the liquid amount Vs of the liquid stored in the second liquid chamber after the initial process is executed; and store the determined liquid amount Vc in the memory through the interface.

(13) Preferably, the liquid discharge device further includes a memory, wherein the controller is configured to: on a condition that a first value corresponding to the fact that the initial process is not executed is read out from the memory, execute the initial process; and based on completion of the initial process, update the first value to a second value corresponding to the fact that the initial process is executed.

According to the above configuration, it is possible to shorten the time until the initial process for flowing the liquid from the second liquid chamber into the head is executed from when the cartridge is installed in the installation case, without entering the air from the second liquid chamber to the head.

What is claimed is:

1. A liquid discharge device comprising:

an installation case configured to receive a cartridge, the cartridge comprising:

a first liquid chamber in which a liquid is stored;

a first flow path, one end of the first flow path being communicated with the first liquid chamber, the other end of the first flow path being communicated with a first location outside of the cartridge; and a second flow path, one end of the second flow path being communicated with the first liquid chamber, the other end of the second flow path being communicated with a second location outside of the cartridge;

a tank comprising:

a second liquid chamber;

a third flow path, one end of the third flow path being communicated with a third location outside of the cartridge, the other end of the third flow path being communicated with the second liquid chamber, at least one of the first flow path and the third flow path being configured to communicate with the first liquid chamber of the cartridge installed in the installation case and the second liquid chamber;

a fourth flow path, one end of the fourth flow path being located below the third flow path communicates with the second liquid chamber; and a fifth flow path, one end of the fifth flow path being communicated with the second liquid chamber, the other end of the fifth flow path being communicated with a fourth location outside of the cartridge;

a head that is communicated with the other end of the fourth flow path; and a controller configured to:

determine that the cartridge is installed in the installation case; and in a case where an elapsed time from a time point at which being determined that the cartridge is installed in the installation sensor reaches a first time, execute an initial process of introducing the liquid stored in the first liquid chamber to the head and the fourth flow path.

2. The liquid discharge device according to claim 1, further comprising:

a temperature sensor, wherein the controller is configured to:

in a case where a temperature determined from a signal received from the temperature sensor is lower than a predetermined temperature, set a second time instead of the first time, the second time being longer than the first time; and execute the initial process based on determining that the elapsed time reaches the second time.

3. The liquid discharge device according to claim 1, further comprising:

an interface, wherein the controller is configured to, on a condition that identification information indicating that an initial volume of liquid is stored in the first liquid chamber is read from a memory of the cartridge through the interface, execute the initial process.

4. The liquid discharge device according to claim 1, further comprising:

a memory, wherein the controller is configured to:

on a condition that a first value corresponding to the fact that the initial process is not executed is read out from the memory, execute the initial process; and based on completion of the initial process, update the first value to a second value corresponding to the fact that the initial process is executed.

5. A liquid discharge device comprising:

an installation case configured to receive a cartridge, the cartridge comprising:

a first liquid chamber in which a liquid is stored;

a first flow path, one end of the first flow path being communicated with the first liquid chamber, the other end of the first flow path being communicated with a first location outside of the cartridge; and a second flow path, one end of the second flow path being communicated with the first liquid chamber, the other end of the second flow path being communicated with a second location outside of the cartridge;

a tank comprising:

a second liquid chamber;

a third flow path, one end of the third flow path being communicated with a third location outside of the cartridge, the other end of the third flow path being communicated with the second liquid chamber, at least one of the first flow path and the third flow path being configured to communicate with the first liquid chamber of the cartridge installed in the installation case and the second liquid chamber;

a fourth flow path, one end of the fourth flow path being located below the third flow path communicates with the second liquid chamber; and a fifth flow path, one end of the fifth flow path being communicated with the second liquid chamber, the other end of the fifth flow path being communicated with a fourth location outside of the cartridge;

a head that communicates with the other end of the fourth flow path;

an interface; and a controller configured to:

determine that the cartridge is installed in the installation case;

after determining that the cartridge is installed in the installation case, read a liquid amount Vc of a liquid stored in the first liquid chamber from a memory of the cartridge through the interface;

based on the read liquid amount Vc, determine a flow rate Qc at which the liquid flows from the first liquid chamber to the second liquid chamber;

calculate a liquid amount Vs of a liquid stored in the second liquid chamber by multiplying the flow rate Qc by an elapsed time from a time point at which being determined that the cartridge is installed in the installation case; and based on the flow rate Qc is equal to or larger than a first threshold and the liquid amount Vs is equal to larger than a second threshold, execute an initial process of introducing the liquid stored in the first liquid chamber to the head and the fourth flow path.

6. The liquid discharge device according to claim 5, wherein the controller is configured to:

on a condition that the flow rate Qc is less than the first threshold, calculate a third threshold obtained by adding a liquid amount Vth to the second threshold, the liquid amount being obtained by multiplying a difference between the first threshold and the flow rate Qc by a time period for which the initial process is to be executed, and in a case where the liquid amount Vs is equal to or larger than the third threshold, execute the initial process of discharging the liquid through the head or the fourth flow path.

7. The liquid discharge device according to claim 5, wherein the controller is configured to:

read the liquid amount Vc of the liquid stored in the first liquid chamber from the cartridge memory through the interface;

based on the read liquid amount Vc, determine the liquid amount Vc of the liquid stored in the first liquid chamber and the liquid amount Vs of the liquid stored in the second liquid chamber after the initial process is executed; and store the determined liquid amount Vc in the memory through the interface.

8. The liquid discharge device according to claim 5, further comprising:

a memory, wherein the controller is configured to:

on a condition that a first value corresponding to the fact that the initial process is not executed is read out from the memory, execute the initial process; and based on completion of the initial process, update the first value to a second value corresponding to the fact that the initial process is executed.

* * * * *